US008341092B2

(12) United States Patent
Gabrielsen et al.

(10) Patent No.: US 8,341,092 B2
(45) Date of Patent: Dec. 25, 2012

(54) PACKAGING SYSTEM AND METHOD WITH FREIGHT RATE ANALYSIS

(75) Inventors: David M. Gabrielsen, Chagrin Falls, OH (US); Daniel L. Carlson, Ravenna, OH (US); Joseph J. Harding, Mentor, OH (US); Thomas A. Bilkie, Jr., Medina, OH (US)

(73) Assignee: Ranpak Corp., Concord Township, OH (US)

( * ) Notice: Subject to any disclaimer, the term of this patent is extended or adjusted under 35 U.S.C. 154(b) by 869 days.

(21) Appl. No.: 12/295,693

(22) PCT Filed: Apr. 2, 2007

(86) PCT No.: PCT/US2007/065778

§ 371 (c)(1),
(2), (4) Date: Apr. 2, 2009

(87) PCT Pub. No.: WO2007/115256

PCT Pub. Date: Oct. 11, 2007

(65) Prior Publication Data

US 2009/0301038 A1 Dec. 10, 2009

Related U.S. Application Data

(60) Provisional application No. 60/744,123, filed on Apr. 1, 2006.

(51) Int. Cl.
*G06Q 30/00* (2012.01)

(52) U.S. Cl. ..... 705/335

(58) Field of Classification Search ..... 705/335
See application file for complete search history.

(56) References Cited

U.S. PATENT DOCUMENTS

2003/0200111 A1* 10/2003 Damji ..... 705/1
2004/0185994 A1* 9/2004 Harding et al. ..... 493/350
2005/0050848 A1* 3/2005 Harding ..... 53/58
2005/0150192 A1 7/2005 Armington et al.

FOREIGN PATENT DOCUMENTS

WO 2004/041653 5/2004

OTHER PUBLICATIONS

Weinstein, Margery. "The Dunnage Balancing Act" Catalog Age; Sep. 2004. p. 29.*
International Search Report of International Application No. PCT/US2007/065778, filed Apr. 2, 2007, published in English as WO/2007/115256.

* cited by examiner

*Primary Examiner* — John Hayes
*Assistant Examiner* — Allen J Jung
(74) *Attorney, Agent, or Firm* — Renner, Otto, Boisselle & Sklar, LLP

(57) ABSTRACT

A packaging method includes the step of comparing a total package weight to a freight rate schedule and thereby determining a normal freight rate. The total package weight includes the weight of a container (22), an article (24) to be shipped and a normal amount of dunnage. If predetermined criteria are met, the method also includes the step of reducing the amount of dunnage dispensed below that of the normal amount of dunnage such that the total package weight falls within a freight rate that is less than the normal freight rate. The predetermined criteria include one or more of a predetermined percentage above a change in freight rate, a predetermined weight above a threshold weight for an increase in freight weight, and dunnage requirements including void-volume, degree of fill for the void-volume, type of article, weight of article and type of dunnage.

13 Claims, 2 Drawing Sheets

PACKAGING SYSTEM AND METHOD WITH FREIGHT RATE ANALYSIS

This application claims the benefit of International Patent Application No. PCT/US2007/065778, filed Apr. 2, 2007, published in English as Publication No. WO/2007/115256 A2, which claims the benefit of U.S. Provisional Application No. 60/744,123, filed Apr. 1, 2006, which are hereby incorporated herein by reference.

FIELD OF THE INVENTION

This invention relates generally to a packaging system and method for providing a quantity of dunnage material for insertion into containers in which one or more articles are to be packed for shipping, and more particularly to a packaging system and method characterized by a determination of the freight rate for a package.

BACKGROUND

In a typical packaging application, articles are placed in a container with a dunnage material for shipment. The dunnage material fills at least a portion of the void between the container and the article to prevent or to minimize movement of the article relative to the container and/or to prevent or to minimize damage to the article during shipment. Some commonly used dunnage materials are plastic foam peanuts, plastic bubble pack, air bags and crumpled paper dunnage.

Many freight haulers base their rates for transporting the packages based on volume, weight, distance transported or combinations thereof. Consequently, packages often are weighed prior to shipment. The freight rates generally include a schedule of prices, each price being assigned to a range of package weights, sizes, transportation zones, or combinations thereof.

SUMMARY

The present invention provides a packaging system and method for optimizing shipping costs in view of a schedule of freight rates based on package weight by selectively reducing the weight of dunnage included in a package. The weight of the dunnage may be reduced by reducing the amount and/or changing the type of dunnage to a lower density dunnage. In some instances, less dunnage can be provided to a container without unreasonably compromising the functional characteristics of the dunnage. Consequently, the amount of dunnage can be adjusted downward to reduce the total package weight and thereby optimize the shipping rate paid for transporting the package. The decision to reduce the amount and/or change the type of dunnage may be made automatically, in which case a packer does not have to make a decision for each individual container as to whether or not to reduce the amount and/or change the type of dunnage, or how much to reduce the amount of dunnage for each individual container.

In particular, the present invention provides a system and method for selectively reducing the amount and/or changing the type of dunnage to be dispensed to a container in view of the total weight of the package, the weight of the dunnage to be dispensed and the schedule of freight rates based on package weight.

An exemplary packaging method of packing an article in a container involves comparing a total package weight to a freight rate schedule and determining a normal freight rate, where the total package weight includes the weight of a container, an article and a normal or first amount of dunnage. If predetermined criteria are met, the method also includes the step of reducing the amount of dunnage dispensed below that of the normal amount of dunnage such that the total package weight falls within a freight rate that is less than the normal freight rate. The predetermined criteria include one or more of a predetermined percentage change in freight rate, a predetermined weight above a threshold weight for an increase in freight weight, and/or dunnage requirements including void-volume, degree of fill for the void-volume, type of article, weight of article and/or type of dunnage.

The method can further include controlling a supply of dunnage to output a reduced amount and/or lower density type of dunnage. The controlling step can include controlling a conversion machine to output the determined type of dunnage, amount of dunnage, and/or controlling the supply of dunnage to stop a dunnage dispenser when the desired package weight is reached. Moreover, the controller can automatically perform the comparison.

The container can be weighed before dispensing dunnage or as the dunnage is placed in the container, and the resulting weight information can be used to control the supply of dunnage. The container also can be weighed after dunnage has been dispensed, and dunnage can be removed from the container as needed to reach the desired package weight.

An exemplary packaging system for packing an article in a container based on one or more dunnage requirements includes a supply of dunnage and a controller operable to control the dunnage supply to dispense a type and an amount of dunnage based on a freight rate schedule and predetermined criteria related to the total weight of a container and its contents. The supply may include multiple types of dunnage, each of which is selectively dispensable from the supply.

The dunnage supply may include a dunnage converter that converts a stock material, such as a sheet stock material, into a length of dunnage.

A sensor may be connected to the controller to transmit sensor data thereto, whereby the controller can determine the void volume in the container based on the sensor data. From the void volume data and the dunnage density the controller can determine the amount of dunnage to dispense to fill the void volume.

The controller includes one or more of a processor; a data storage device; an output device, such as a display; and an input device, such as a pointing device, a keyboard, a bar code scanner, a scale and a sensor for detecting one or more dimensions.

The freight rate schedule includes a plurality of rates and a range of weights associated with each rate. The freight rate schedule may include a plurality of sets of freight rates for respective container sizes. A communication device may be provided for downloading a freight weight schedule from a source thereof, such as at a periodic or other time interval, or as needed.

The present invention also provides a system and method for analyzing packaging data. Such a system may include a supply of dunnage, a sensor for determining a characteristic of a container, and a controller in communication with the sensor. The controller is suitably programmed to calculate the freight rate of each of a plurality of containers for which a first type of dunnage is dispensed from the supply and to compare the freight rate to the freight rate that would have been incurred if a second type of dunnage were dispensed from the supply. The controller may select the type of dunnage to dispense to optimize the freight rate without unreasonably compromising the functional characteristics of the dunnage.

The foregoing and other features of the invention are shown in the drawings and particularly pointed out in the claims. The following description and annexed drawings set forth in detail one or more illustrative embodiments of the invention; this being indicative, however, of but one or a few of the various ways in which the principles of the invention might be employed.

BRIEF DESCRIPTIONS OF THE DRAWINGS

DETAILED DESCRIPTION

The present invention provides a packaging system and method for optimizing shipping costs in view of a schedule of freight rates based on package weight by selectively reducing the weight of dunnage included in a package. The weight is reduced by reducing the amount and/or changing the type of dunnage to a lower density dunnage. In some instances, less dunnage or a lower density dunnage can be provided to a container without unreasonably compromising the functional characteristics of the dunnage. Consequently, the amount of dunnage can be adjusted downward or the type of dunnage can be changed to reduce the total package weight and thereby optimize the freight rate (sometimes referred to as the shipping rate) paid for transporting the package. The decision to reduce the amount of dunnage or change to a lower density dunnage is made automatically. A packer does not have to make a decision for each individual container as to which type of dunnage to use, whether or not to reduce the amount of dunnage, or how much to reduce the amount of dunnage for each individual container.

In particular, the present invention provides a packaging system and method for selectively reducing the amount and/or change the type of dunnage to be dispensed in view of the total weight of the package, the weight of the dunnage and the schedule of freight rates. The total package weight includes the weight of a container, at least one article to be packed in the container, and a normal or first amount of dunnage. The density of the dunnage is known or predetermined and allows for the determination of the weight of the dunnage to be dispensed. The total package weight also may include labels and any devices used to close the container, such as staples, adhesives, tapes, straps, etc., although the weight of these materials may be negligible and may be omitted in some circumstances.

Figure 1:
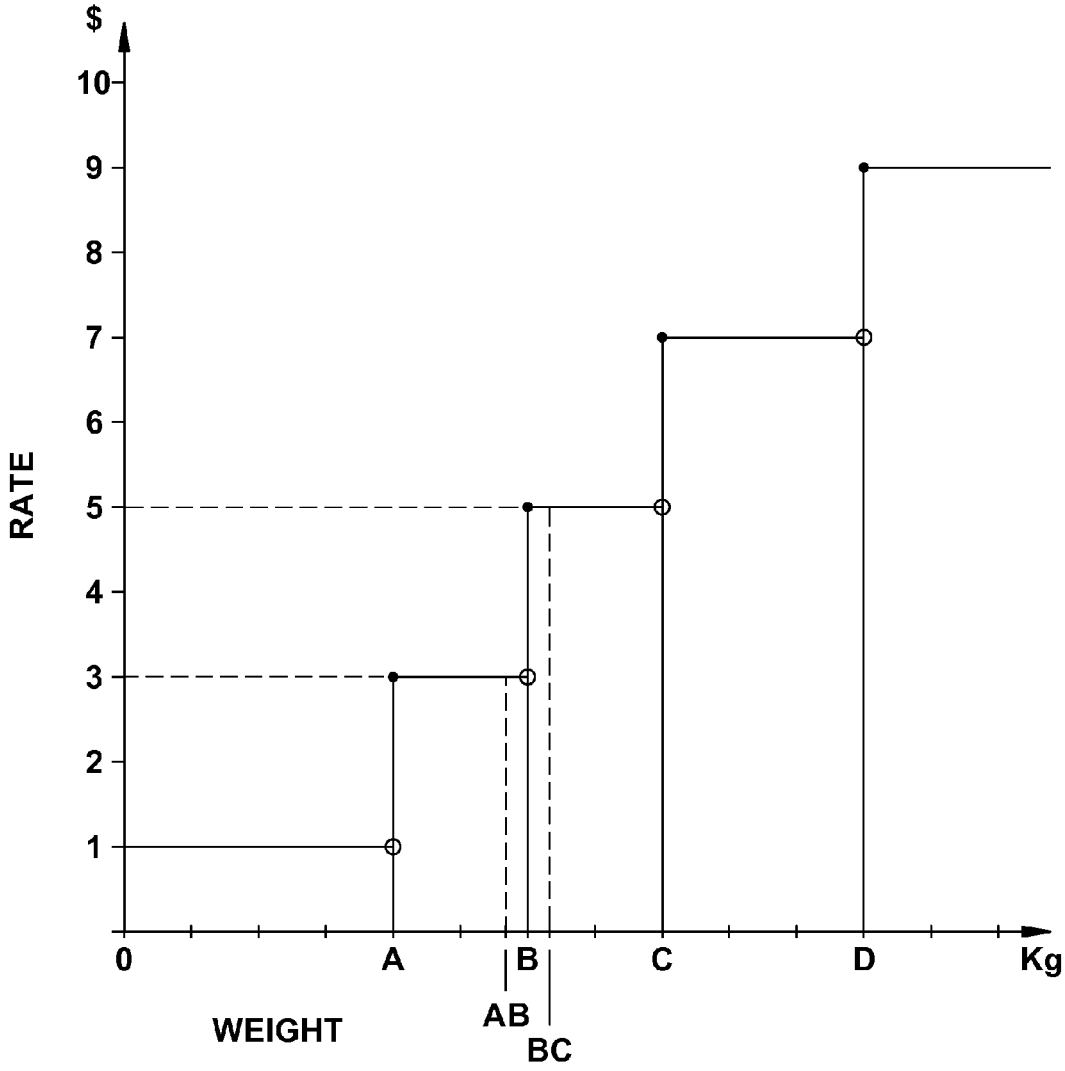
FIG. 1 is a chart of freight rate versus weight for an exemplary freight rate schedule that illustrates a feature of the present invention.

The freight rate for a package generally is based on a schedule of freight rates where each rate is applicable to a corresponding range of package weights. An exemplary freight rate schedule based on package weight is graphically illustrated in FIG. 1. The weight increases along the X-axis and the freight rate increases in steps along the Y-axis. Thus, a range of weights (e.g. measured in kg) from 0 up to but not including A, A up to but not including B, B up to but not including C, etc. incur corresponding freight rates (e.g. measured in currency, such as dollars) of 1, 2, 3, 5, etc. For example, a package weight at BC (for example, 11 kg) will incur a freight rate of $5. If that freight weight BC is within a specified percentage, for example, 10%, greater than weight B (for example, 10 kg), or within a certain weight of dunnage that can be reduced, such as 1.1 kg, then the amount of dunnage can be reduced to provide a total package weight AB (for example, 9.9 kg) that is less than weight B to provide a lower freight rate of $3. The percentage or weight used to determine whether to reduce the weight of the dunnage may vary as a function of the void being filled. Typically, a larger variance may be allowed if a larger quantity of dunnage is needed for the container. The percentage or dunnage weight also may be a function of the type of product being shipped, such as a lower variance being allowed for fragile items.

An exemplary method provided by the present invention generally includes comparing the total package weight to a freight rate schedule based on the weight of a normal or first amount of a type of dunnage to determine a first or normal freight rate. If predetermined criteria are met, the next step in the method includes reducing the amount and/or changing the type of dunnage placed in the container to an amount or a density that is less than that of the normal or first amount of dunnage. This second or reduced amount of dunnage, combined with the other components of the total package weight, provides a reduced total package weight that falls within a range of weights for a second or reduced freight rate that is less than the normal freight rate. In analyzing the predetermined criteria, the method can consider one or more of a predetermined percentage above a change in freight rate, a predetermined weight above a threshold weight for an increase in freight rate; dunnage requirements including void volume, degree of fill for the void volume, type of article, weight of article, and type of dunnage.

A normal amount of dunnage is one that generally would ensure a high degree of certainty in preventing shipping damage, while a reduced amount of dunnage provides a reasonable degree of certainty in preventing shipping damage. The amount of dunnage that can provide the necessary protection for the articles being shipped depends on characteristics of the container and/or the article, such as fragility; size; shape; weight; and/or mode of transport such as by ship, train, or truck, for example; as well as the characteristics of the dunnage itself. These factors can be predetermined such that the reduced amount of dunnage is sufficient to maintain the desired functions of the dunnage material in the container and at least a reasonable certainty in preventing shipping damage.

The method may include the step of changing the type of dunnage dispensed to a less dense dunnage, either in addition to or as an alternative to reducing the amount of dunnage dispensed, as another way to reduce the total package weight.

Depending on the freight rate schedule, it may be more economical to use one type of dunnage over another in different situations. For example, the supply may include two types of dunnage. A first type of dunnage might be less expensive to produce per unit of volume, but more dense than a second type of dunnage. In situations where the weight of a container is close to the weight where the freight rate increases, dispensing the first type of dunnage might be preferable if doing so keeps the total package weight within the weight range for a lower freight rate.

Recall the example given above, where the weight of dispensed dunnage is desirably reduced below a transition weight, B, 10 kg for example, where the freight rate increases. The total package weight was reduced from 11 kg to 9.9 kg in this example. A first type of dunnage, such as crumpled paper, may be preferred over a second type of dunnage, such as air bags, with a lower density (less weight per unit of volume dispensed). The first type of dunnage may be preferred based on cost, for example (e.g., cost/density), or functional characteristics (e.g., better cushioning properties). We can assume that the first type of dunnage has a normal amount that provides an estimated total package weight of 11 kg. If this first type of dunnage meets percentage or weight reduction criteria to provide an estimated total package weight that is less than the transition weight B (10 kg), such as 9.9 kg in the above example, then the reduced amount of the first type of dunnage may be dispensed. And the freight rate also is reduced, to three dollars in this example. If the estimated total package weight, 14 kg, for example, does not meet the predetermined criteria for the first type of dunnage (more than 10% or 1.1 kg above the transition weight B) the second type of dunnage should be considered. This is because even the reduced amount of the first type of dunnage would still be above the transition weight B for that freight rate (five dollars in this example).

The second type of dunnage may have a normal amount that also provides an estimated total package weight that is above the transition weight B, but is less than the estimated total package weight for a normal amount of the first type of dunnage. This estimated total package weight may be 10.6 kg, for example. If the reduced amount of the second type of dunnage meets the predetermined percentage or weight reduction criteria (in this case, perhaps the criteria for the second type of dunnage is 15% or about 1.6 kg), then the reduced amount of the second type of dunnage will be dispensed. In this example, this would provide an estimated total package weight B, such as 9 kg, that is less than the transition weight. If the estimated total package weight for a normal amount of the second type of dunnage does not meet the predetermined criteria for the second type of dunnage, then no change is made and the freight rate is not reduced. In that case, a normal amount of the first type of dunnage is dispensed, since the first type of dunnage is preferred and a normal amount generally provides better functional characteristics.

Not all containers passing through the system would be expected to receive a reduced weight of dunnage. In a high volume situation, however, even a small reduction in freight rates can provide substantial savings in shipping costs.

Figure 2:
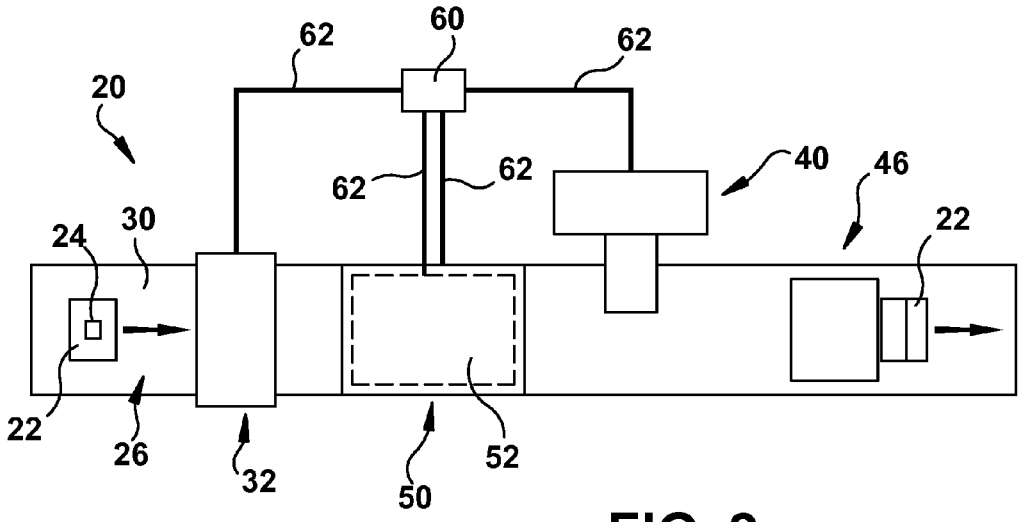
FIGS. 2 and 3 are schematic top and side views of an exemplary packaging system for carrying out one or more aspects of the present invention.
Figure 3:
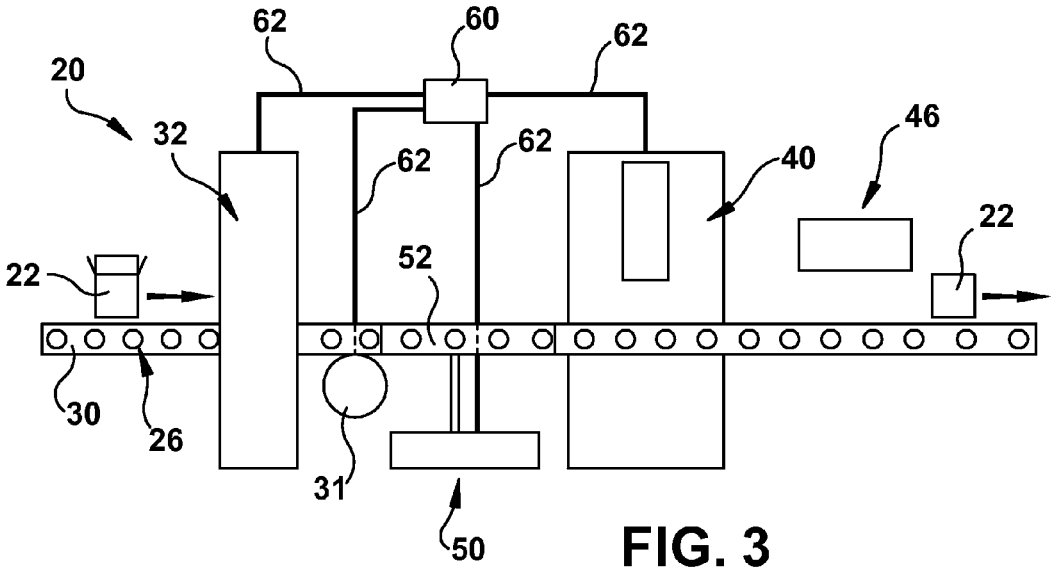

An exemplary packaging system 20 for packing an article in a container is shown in FIGS. 2 and 3. At the left is a container 22 with an article 24 placed therein for shipment. A transport network 26, which in this case includes a conveyor 30, transports the container 22 through the packaging system 20. The conveyor 30 can include one or more separate conveyor segments controllably driven by one or more motors 31.

In the illustrated embodiment, the container 22 first passes through a scanning station 32 where a sensor (not shown) identifies the container and/or senses a characteristic of the container, a characteristic of the article therein, and/or characteristics of the void volume in the container not occupied by the article. The container 22 is then transported to a supply of dunnage 40 which dispenses dunnage to the void in the container. The supply of dunnage 40 may include any type of dunnage, such as foam "peanuts," air bags, foam strips or bags, paper pads, paper strips, etc. The supply of dunnage 40 may include multiple, selectively dispensable, types of dunnage. Further, the supply of dunnage may include a dunnage conversion machine for converting a stock material into a relatively less dense dunnage.

Downstream of the dunnage supply 40 is a taping or closing station 46 where the container 22 is closed, for example by folding and securing flaps of a RSC (regular slotted container) or placing a lid on the container. The container can be secured in a closed condition with tape, staples, straps, glue, etc.

In the illustrated embodiment, the container 22 also passes through a weigh station 50 that has a scale 52 for weighing the container 22 and the article 24 therein. The scale 52 may be incorporated into the scanning station 40, or separately located upstream or downstream of the scanning station. Thus the method can include weighing the container and the article therein before dispensing dunnage. Alternatively, the method can include weighing the container and the article as the dunnage is placed in the container, and stopping the dunnage dispenser when the desired package weight is reached. As another alternative, the container can be weighed after the dunnage has been dispensed and dunnage can be removed from the container until the desired package weight is reached. In some situations the scale 52 can be omitted.

A controller 60 in communication with the supply of dunnage 40 can controllably dispense a determined amount and/or type of dunnage from the supply based on the freight rate schedule and the predetermined criteria related to the dunnage requirements. The controller 60 can control or otherwise communicate with other elements of the packaging system 20, including the transport network 30, the scanning station 32, the weigh station 50 and/or the taping station 46, via one or more wired or wireless communication lines 62. The controller 60 can include one or more of a processor, a data storage device, an output device, such as a display, and an input device, such as a pointing device, a keyboard, a bar code scanner, a scale and a sensor for detecting one or more dimensions of a container. Thus reducing the weight of dunnage can include controlling the supply of dunnage 40 to dispense the determined type of dunnage, reduced amount of dunnage, and/or controlling a conversion machine to produce the determined reduced amount of dunnage.

If the controller 60 obtains the necessary data, such as one or more container characteristics from a sensor, and/or other data, such as a database of container and article weights and the density of the dunnage, the controller can estimate the weight of the package, the type of dunnage, and the quantity of dunnage needed. In such a system, the scanning station 32 might only identify a characteristic of a container, such as a bar code that identifies the container and the article packed therein. The weight and volume of the identified container and article can be retrieved from the database to determine the void volume and the normal quantity of dunnage. The controller can use this information to estimate the total package weight and compare it to the freight rate schedule. The controller then can automatically determine whether to change to a lower density type of dunnage and/or to reduce the quantity of dunnage. The controller can control the supply of dunnage to dispense either the normal quantity or the reduced quantity of dunnage of a desired type.

The system also provides a way to compare shipping rates for different types of dunnage. In some packaging situations different types of dunnage, such as crumpled paper dunnage products and air bags, would be acceptable for packaging articles in a container. Different types of dunnage generally have different densities. For each type of dunnage, a different quantity may be needed to ensure a high degree of certainty in article protection (a normal amount of dunnage) and to ensure a reasonable degree of certainty (a reduced amount of dunnage less than the normal amount). The normal and reduced amounts for a particular type of dunnage may be dependent on characteristics of the product being shipped, such as weight, fragility, etc. If all other factors are equal, the use of different types of dunnage would probably result in different amounts of freight rate cost savings from systems and methods in accordance with the present invention. Whether or not a different type of dunnage is dispensed, a comparison of the package weights and freight rates resulting from the use of systems and methods in accordance with the invention can be output or stored in a memory for later retrieval from the controller.

The present invention also provides a system and method for extracting and analyzing packaging data from a packing facility for allowing an end user to determine the sensitivity of its packaging costs to a particular type of dunnage relative to other types of dunnage. The system and method may include a sensor for measuring the void in a container, and a controller suitably programmed to calculate the freight rate or shipping cost of each container being packed with a particular type of dunnage, and then to compare that cost to the shipping cost that would have been incurred if the container were packed with one or more different types of dunnage. Provision also may be made for determining those events resulting in higher (and/or lesser) cost and for reporting the data in various formats including tables and charts. Consequently, an end user may determine for a particular packaging line that one type of dunnage is more economical than another type.

Cost comparisons presumably have in the past been made between various types of void fill dunnage material and some of the comparisons may have taken shipping costs into account. These comparisons were based on hypothetical container data, however, rather than the shipping cost for actual containers being packed. No comparisons of shipping costs for actual containers and different types of dunnage are known. The present invention also provides a system and method for automatically acquiring actual packing data and reporting comparison data to an end user. The invention thus also provides a way to accumulate marketing data.

Although the invention has been shown and described with respect to certain preferred embodiments, equivalent alterations and modifications will occur to others skilled in the art upon reading and understanding this specification and the annexed drawings. In particular regard to the various functions performed by the above described integers (components, assemblies, devices, compositions, etc.), the terms (including a reference to a "means") used to describe such integers are intended to correspond, unless otherwise indicated, to any integer which performs the specified function of the described integer (i.e., that is functionally equivalent), even though not structurally equivalent to the disclosed structure which performs the function in the herein illustrated exemplary embodiment or embodiments of the invention. In addition, while a particular feature of the invention might have been described above with respect to only one of several illustrated embodiments, such feature can be combined with one or more other features of the other embodiments, as can be desired and advantageous for any given or particular application.

What is claimed:

1. A packaging method for packing an article in a container comprising the following steps:

comparing a total package weight that includes the weight of a container, an article and a normal amount of dunnage, to a freight rate schedule and thereby determining a normal freight rate, including using a controller automatically to compare the total package weight to a freight rate schedule, the controller including a computer processor configured to carry out the following steps; where if predetermined criteria are met, controlling by the computer processor a supply of dunnage to output an amount of dunnage below that of the normal amount of dunnage such that the total package weight falls within a freight rate that is less than the normal freight rate; wherein the predetermined criteria include one or more of a predetermined percentage above a change in freight rate; a predetermined weight above a threshold weight for an increase in freight weight; dunnage requirements including void volume, degree of fill for the void volume, type of article, weight of article and type of dunnage; and if the predetermined criteria are not met, controlling by the computer processor the supply of dunnage to output the normal amount of dunnage.

2. A method as set forth in claim 1, wherein the controlling step includes controlling a conversion machine to output the determined amount of dunnage.

3. A method as set forth in claim 1, wherein the controlling step includes stopping the supply of dunnage from dispensing dunnage when the desired package weight is reached.

4. A method as set forth in claim 1, comprising the step of weighing the container and the article therein before dispensing dunnage.

5. A method as set forth in claim 1, comprising the step of weighing the container and the article therein as the dunnage is placed in the container.

6. A method as set forth in claim 1, comprising the steps of weighing the container after dunnage has been dispensed and removing dunnage until the desired package weight is reached.

7. A packaging system for packing an article in a container based on one or more dunnage requirements, comprising a supply of dunnage and a computer processor configured to carry out the following steps:

comparing a total package weight that includes the weight of a container, an article and a normal amount of dunnage, to a freight rate schedule and thereby determining a normal freight rate, including using a controller automatically to compare the total package weight to a freight rate schedule; where if predetermined criteria are met, controlling a supply of dunnage to output an amount of dunnage below that of the normal amount of dunnage such that the total package weight falls within a freight rate that is less than the normal freight rate; wherein the predetermined criteria include one or more of a predetermined percentage above a change in freight rate; a predetermined weight above a threshold weight for an increase in freight weight; dunnage requirements including void volume, degree of fill for the void volume, type of article, weight of article and type of dunnage; and if the predetermined criteria are not met, controlling the supply of dunnage to output the normal amount of dunnage.

8. A system as set forth in claim 7, wherein the dunnage supply includes multiple types of dunnage, each type having a different density.

9. A system as set forth in claim 7, wherein the dunnage supply includes a dunnage converter that converts a stock material into a length of dunnage that is relatively less dense than the stock material.

10. A system as set forth in claim 7, comprising a sensor connectable to the computer processor to transmit sensor data to the computer processor, the computer processor being operable to determine the void volume in the container based on the sensor data.

11. A system as set forth in claim 7, further comprising one or more of a data storage device; an output device, such as a display; and an input device, such as a pointing device, a keyboard, a bar code scanner, a scale and a sensor for detecting one or more dimensions.

12. A system as set forth in claim 7, wherein the freight rate schedule includes a plurality of rates and a range of weights associated with each rate.

13. A system as set forth in claim 7, wherein the freight rate schedule includes a plurality of sets of freight rates for respective container sizes.

* * * * *